United States Patent [19]

Goyal

[11] 3,938,282

[45] Feb. 17, 1976

[54] SLIDING DOOR OPERATOR

[75] Inventor: Raghbir C. Goyal, Niles, Mich.

[73] Assignee: Kawneer Company, Inc., Niles, Mich.

[22] Filed: Feb. 1, 1974

[21] Appl. No.: 438,593

[52] U.S. Cl. ..... 49/137; 49/138; 49/264; 49/360; 91/31

[51] Int. Cl.[2] ..... E05F 15/02

[58] Field of Search ..... 49/30, 137, 138, 264, 360; 91/31, 407

[56] References Cited

UNITED STATES PATENTS

| | | | |
|---|---|---|---|
| 700,404 | 5/1902 | Braden et al. | 49/137 X |
| 1,479,386 | 1/1924 | Hynes et al. | 49/137 X |
| 3,186,307 | 6/1965 | Ellenbogen | 91/31 |
| 3,260,164 | 7/1966 | Guentner et al. | 60/407 X |
| 3,619,946 | 11/1971 | Crocker | 49/264 |

*Primary Examiner*—Kenneth Downey
*Attorney, Agent, or Firm*—Mason, Kolehmainen, Rathburn & Wyss

[57] ABSTRACT

An automatic sliding door operator for a door mounted upon a door frame for sliding movement in a vertical plane between opened and closed positions includes a drive cylinder to open and close the door by means of a drive piston slideably movable within the drive cylinder between fluid inlets located at each end of the cylinder. Control means are provided to couple a first fluid inlet of the drive cylinder through a controlled source of fluid pressure and to exhaust the opposite fluid inlet continuously throughout an opening stroke of the door and for connecting the second fluid inlet to the source of fluid pressure and exhausting the first fluid inlet continuously throughout a closing stroke of the door. The closing and opening rates of the door is controlled by suitable exhaust metering means continuously metering the exhaust flow of fluid. The exhaust metering means includes separate door moving metering controls and door cushioning metering controls so as to control the deceleration of the door as it approaches the end of its stroke and to assist in bringing the door to a gentle stop at its opened or closed position.

8 Claims, 20 Drawing Figures

40
57
58
55F
55A
55
55C
63
60F
60H
60A
65
65F
65A
69
34
37
56
55E
55B
60E
60C
65C
67
55D
55G
62
60D
60G
60
60B
65D
65B
65E
66
35
21
52C
52
52B
52A
32
38
33
36
43
42
42A
44A
44B
44D
47C
49
51
22
42C
42B
44
44E
44C
47
48C
47B
47A
48
48B
48A
50

40
57
58
55F
55A
55
55C
63
60F
60H
60A
65
65F
65A
69
34
37
56
55E
55B
60E
60C
65C
67
32
35
55D
55G
62
60D
60G
60
60B
65D
65B
65E
66
38
21
52C
52
52B
52A
33
36
51
43
42
42A
44A
44B
44D
47C
49
22
42C
42B
44
44E
44C
47
48C
47B
47A
48
48B
48A
50

40
57
58
55F
55A
55
55C
63
60F
60H
60A
65
65F
65A
69
34
37
55E
55B
60E
60C
65C
67
56
55D
55G
62
60D
60G
60
60B
65D
65B
66
52C
52
52B
52A
65E
35
21
32
38
33
36
43
42
42A
42B
42C
22
47C
47
49
47A
47B
48C
48
48B
48A
50
51

40
57
58
55F
55A
55
55C
63
60F
60H
60A
65
65F
65A
69
34
37
55E
55B
60E
60C
65C
67
56
55D
55G
62
60D
60G
60
60B
65D
65B
66
52C
52
52B
52A
65E
35
21
32
38
33
36
43
42
42A
42B
42C
44A
44D
44B
44
44E
44C
22
47C
47
49
47A
47B
48C
48
48B
48A
50
51

57
58
55F
55
55A
55C
63
60F
60H
60A
65
65F
65A
69
34
37
56
55E
55D
55G
62
55B
60E
60C
65C
67
35
21
38
40
52C
52
52A
52B
60D
60G
60
60B
65D
65E
65B
66
32
33
36
43
42
42A
42B
42C
44A
44B
44D
44
44E
44C
47C
47
49
47A
47B
48C
48
48B
48A
50
51
22

57
58
55F
55A
55
55C
63
60F
60H
60A
65
65F
65A
69
34
37
56
55E
55D
55G
62
55B
60E
60C
65C
67
35
21
38
40
52C
52
52A
52B
60D
60G
60
60B
65D
65E
65B
66
32
33
36
43
42
42A
42B
42C
44A
44B
44D
44
44E
44C
47C
47
49
47A
47B
48C
48
48B
48A
50
51
22

40
57
58
55F
55
55A
55C
63
60F
60H
60A
65
65F
65A
69
37
55E
55B
60C
65C
67
56
55D
55G
62
60D
60G
60
60B
65D
65B
65E
66
35
21
52
52C
52B
52A
32
38
33
36
43
42
42A
44A
44B
44D
47C
49
51
22
42C
42B
44
44E
44C
47A
47
48C
47B
48A
48
48B
50

40
57
58
55F
55
55A
55C
63
60F
60H
60A
65
65F
65A
69
34
37
55E
55B
60E
60C
65C
67
56
55D
55G
62
60D
60G
60
60B
65D
65B
65E
66
35
21
52
52C
52B
52A
32
38
33
36
43
42
42A
44A
44B
44D
47A
47C
49
51
22
42C
42B
44
44E
44C
47
48C
47B
48
48B
48A
50

40
21
22
32
33
34
35
36
37
38
42
42A
42B
42C
43
44
44A
44B
44C
44D
44E
47
47A
47B
47C
48
48A
48B
48C
49
50
51
52
52A
52B
52C
55
55A
55B
55C
55D
55E
55F
55G
56
57
58
60
60A
60B
60C
60D
60E
60F
60G
60H
62
63
65
65A
65B
65C
65D
65E
65F
66
67
69

40
41
42
44
47
48
49
50
52
55
56
57
58
60
62
63
65
67

PRESSURE
EXHAUST

SLIDING DOOR OPERATOR

This invention relates to automatic sliding door operators, and more particularly, to a new and improved pneumatic system for automatically opening and closing a sliding door. The invention also relates to a new method and means of decelerating the door as it approaches the ends of its strokes.

Commercially available automatic door operators are used to open and close a door which is mounted upon a door frame for sliding movement in a vertical plane between opened and closed positions. One such type of automatic door operator is normally mounted in the transom bar of the door frame above the door and utilizes a drive piston which is connected to the door and which is sildeably movable within a drive cylinder between fluid inlets located at each end of the cylinder. Upon the actuation of a suitable sensing device, such as a treadle mat or photoelectric cell, in response to movement of traffic adjacent the door, a control valve supplies pressurized fluid to one of the fluid inlets and exhausts the other fluid inlet. The resulting fluid flow within the drive cylinder causes the drive piston to move toward the other air inlet and the door is slideably moved toward its open position. Similarly, in response to the absence of traffic near the door, the control valve supplies air to the drive cylinder in such a manner that the drive piston moves the door toward its closed position.

In these types of door operators, the amount of fluid supplied to the drive cylinder must be of sufficient magnitude to rapidly accelerate the drive piston toward the other end of the drive cylinder so that the door is opened or closed in a minimal amount of time. However, the rapid initial acceleration and speed of the door while being opened or closed necessitates the use of some type of cushioning or deceleration means to decelerate the door and to cushion the end of its travel. Commercially available cushioning devices are commonly of the pneumatic type in which a pneumatic cylinder is provided with a spring biased piston which the door strikes as the door reaches its fully opened or closed position. The resulting force applied to the door by the spring and the pneumatic pressure formed within the cylinder decelerates the door in the required distance, but normally causes some type of oscillation of the door after the door reaches its fully opened or closed position so that the door is not brought to a gentle stop. Yet another type of commercially available cushioning device or decelerating means provides for a reversal of the drive fluid such that the high pressure fluid is connected to the down stream side of the drive piston so as to create a reverse pressure sufficient to decelerate and cushion the termination of the door stroke.

Accordingly, one object of the present invention is to provide a new and improved automatic door operator for sliding doors.

Another object of the present invention is to provide a new and improved arrangement for decelerating automatic sliding doors and for cushioning the termination of their travel.

In accordance with these and many other objects there is provided an improved automatic sliding door operator used in opening and closing a sliding door of the type which is mounted upon a door frame for sliding movement in a vertical plane between opened and closed positions in response to movement of traffic adjacent the door. A drive cylinder is mounted relative to the door frame and having first and second fluid inlets at opposite ends thereof. Typically, the working medium is compressed air, but other suitable fluids may be used. A piston is provided slideably mounted within the drive cylinder for operation through door opening and door closing strokes and arranged to travel between the opposed fluid inlets. Suitable means are provided for connecting the piston to a door to drive the door through the door opening and door closing strokes in response to the movement of the piston. A source of pressurized fluid, such as compressed air, is connected to the first and second fluid inlets and is operable to supply pressurized fluid to either of the fluid inlets in response to the mode called on by the door. Control means are coupled to the fluid source so that during a door opening cycle the compressed air is connected to the first fluid inlet and the second fluid inlet is exhausted continuously throughout the opening stroke. During a closing stroke, the source of compressed air is connected continuously throughout to the second fluid inlet and the first fluid inlet is continuously exhausted to the atmosphere. To control the deceleration of the door and provide a cushioning of the door at the end of its strokes there is provided exhaust metering devices which continuously restrict or meter the exhaust flow from the drive cylinder thereby creating back pressures which decelerate the door and bring the door to a smooth, gentle stop. In a preferred embodiment, the exhaust metering means includes separate opening cycle metering controls and closing cycle metering controls; each of the metering controls includes separate cushioning controls which are rendered operative to cushion a door as it approaches the end of its stroke.

Many other objects and advantages of the present invention will become apparent from considering the following detailed description in connection with the drawings in which:

FIG. 6 is a schematic diagram of the door operator shown with the door in an at-rest or closed position;

FIGS. 14, 15 and 16 are schematic diagrams of the door operator shown in a special mode condition wherein the open signal has been removed from the door during the door opening stroke;

Figure 2:
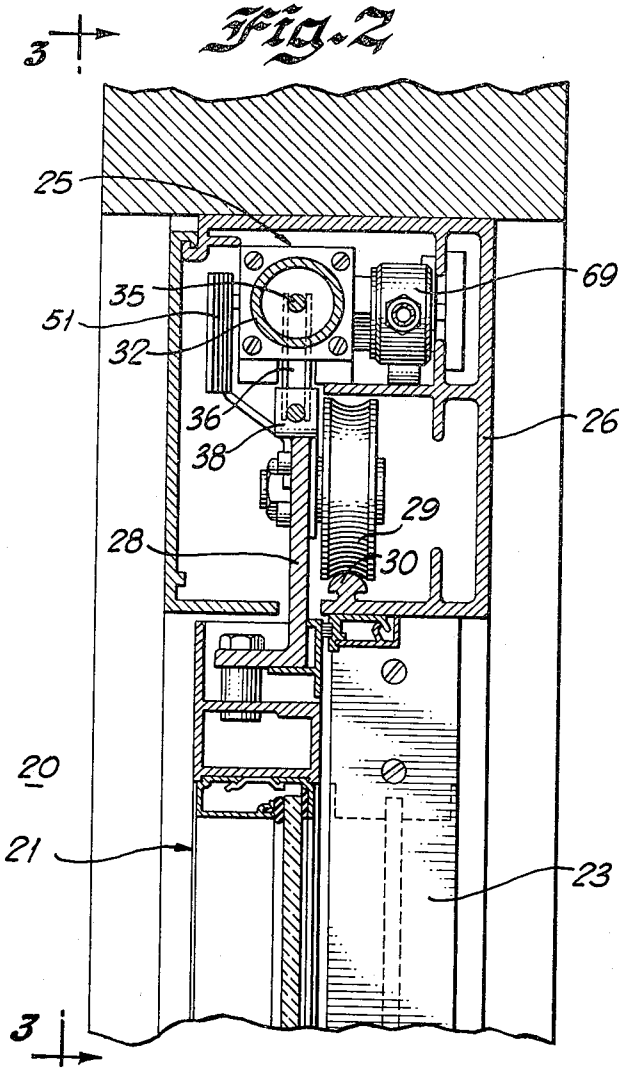
FIG. 2 is a fragmentary cross sectional view of the entrance taken along line 2—2 of FIG. 1.
Figure 1:
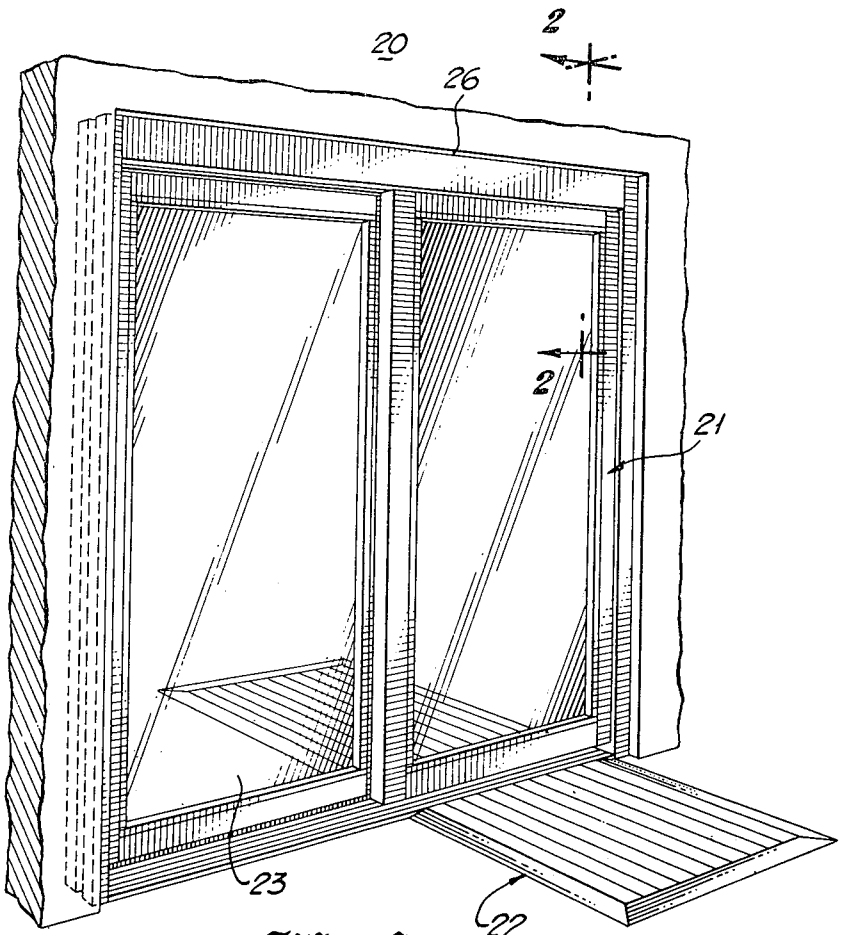
FIG. 1 is a perspective view of a door frame or entrance embodying the present invention.

Referring now to the drawings, and particularly to FIGS. 1–5, there is illustrated a door frame or entrance 20 which embodies the present invention. The entrance 20 includes a door 21 mounted for sliding movement in a vertical plane between opened and closed positions. Upon actuation of a suitable sensing device, such as a treadle mat 22, the door 21 is moved to its opened position in front of a sidelite or panel 23 by an automatic door operator 25 that is substantially located in an overhead transom bar 26 which forms a part of the door frame 20. In the absence of actuation of the treadle mat 22 for a specified period of time, the door operator 25 returns the door 21 to its normally closed position as shown in FIG. 1.

The door 21 is slideably mounted on the door frame 20 by a door carriage 28 having a pair of wheels 29 to allow the movement of the door 21 along a track 30 located in the overhead transom bar 26.

Figure 3:
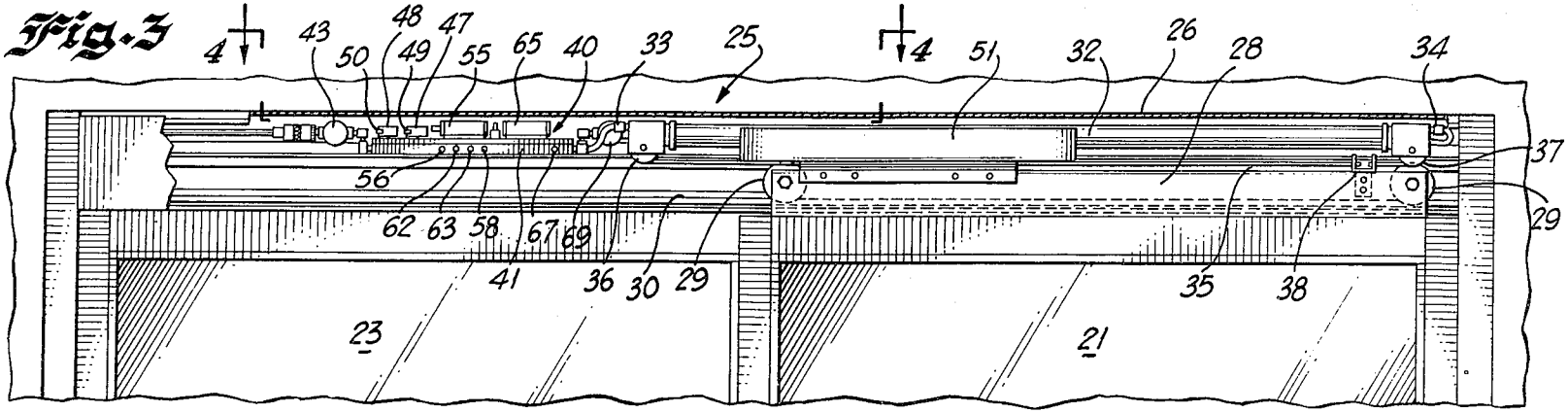
FIG. 3 is an elevational view of the top portion of the entrance shown in FIG. 1, with the front portion of the door frame removed, as taken along line 3—3 of FIG. 2.
Figure 4:
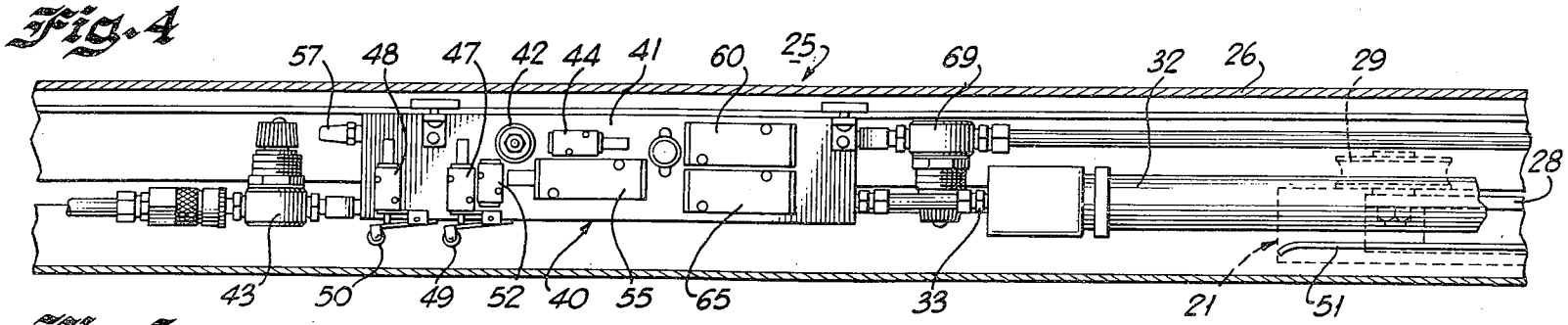
FIG. 4 is a fragmentary, enlarged plan view of the automatic door operator taken along line 4—4 of FIG. 3 and shown with the door in a closed position.
Figure 5:
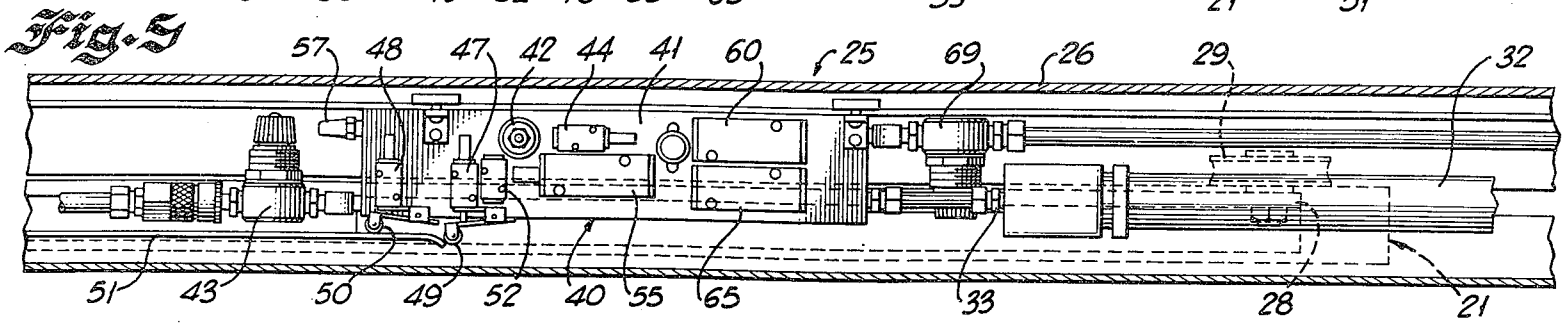
FIG. 5 is a fragmentary plan view of the door operator similar to FIG. 4, and shown with the door in an open position.

The door operator 25, as best illustrated in FIGS. 3, 4 and 5, includes a drive cylinder 32 provided with fluid or air inlets or ports 33, 34 at opposite ends. A drive cable 35 extends through and along the length of the drive cylinder 32 and is connected to the door carriage 28 by a drive yoke 38. The drive cable 35 is guided for movement in and around the drive cylinder 32 by a pair of guide rollers 36, 37 which are located adjacent the air inlets 33, 34 respectively. By simply connecting an auxiliary or slave cable to the drive yoke 38, the door operator 25 can be used to open a pair of sliding doors as well as those illustrated in the present drawings.

In addition to the drive cylinder 32, the automatic door operator 25 includes a control module 40 and including a chassis 41 mounting the electrical and pneumatic controls. A solenoid valve 42 constitutes the only electrical control of the control module 40 and is connected to receive a signal from the sensing device such as the treadle mat 22 either directly or through an electrical sensor. The solenoid valve 42 includes a spool member 42A spring biased to an opened position between ports 42B, 42C and effective when energized to provide a passageway between the ports 42B, 42C. A source of pressurized fluid, such as compressed air (not shown) is supplied to the solenoid valve 42 through a primary pressure regulator 43.

The fluid source is also connected to a transfer or interface valve 44. Interface valve 44 is a spring biased, pneumatically actuated, four-way pneumatic valve provided with a spool 44A, inlet port 44B, and outlet ports 44C, 44D. The port 42B of the solenoid valve 42 is connected to a pneumatic control area 44E of the interface valve 44. The exhaust ports 44C, 44D are connected respectively to pneumatic switches 47, 48. Each of the pneumatic switches 47 and 48 include a spring biased spool 47A, 48A and inlet ports 47B, 48B, and outlet ports 47C, 48C. Each of the pneumatic switches 47, 48 are normally closed, but are opened through a suitable roller 49, 50 by a cam 51 carried on the door 21. The pneumatic switches 47, 48 are each connected to a shuttle valve 52 having a pair of inlet ports 52A, 52B. The shuttle valve 52 is effective, when a pneumatic impulse is received at either of the inlet ports 52A or 52B, to provide pressurized air at the exhaust port 52C. The exhaust port 52C in turn is connected to a four-way, five-ported speed control valve 55. The control valve 55 includes a spring biased spool 55A controlling the exhaust from the drive cylinder 32 through inlet ports 55B, 55C and outlet ports 55D, 55E, 55F. The exhaust port 52C of the shuttle valve 52 connects with a pneumatic control area 55G of the control valve 55. Flow from the exhaust port 55D passes through a closing cushion metering assembly 56, such as a needle valve, to exhaust to atmosphere through a muffler or exhaust 57. The exhaust port 55E is connected directly to exhaust 57 without restraint. The exhaust port 55F is connected to the exhaust 57 through an opening cushion metering assembly 58.

The interface valve 44 controls an additional four-way five-ported directional control valve 60 and includes a spool 60A controlling the flow between inlet ports 60B, 60C and outlet ports 60D, 60E, 60F. The spool 60A is shiftable to the right when a pneumatic bias is applied to a pneumatic control area 60G, and is shiftable to the left when a pneumatic bias is applied to a pneumatic control area 60H of the control valve 60. When the spool 60A is shifted to the left, as viewed in FIG. 6, the port 60E will be connected to the port 60C and the port 60D will be connected with the port 60B. When the spool 60A shifts to the right, as viewed, for example, in FIG. 7, port 60E will communicate with port 60B and port 60F will communicate with port 60C. Moreover, port 60D of the control valve 60 is connected to the port 55B of the control valve 55 through a closing speed metering assembly 62 and the port 60F of the control valve 60 is connected to the port 55C of the control valve 55 to an opening speed metering assembly 63. The ports 60B and 60C of the control valve 60 respectively are connected to the air inlets 33, 34 at opposite ends of the drive cylinder. The connection between the port 60B and the air inlet 33 passes through a secondary speed control valve 65 and one branch of a parallel circuit including an unrestricted flow circuit 66 and a secondary speed metering assembly 67. The control valve 65 includes a spool 66A shiftable between a left and right-hand condition in response to a pneumatic bias applied to a left control port 65E or to a right control port 65F. The control valve 65 additionally includes ports 65B, 65C and 65D. The control valve 65 is effective, with the spool to the left, to connect the port 65D and port 65B so that flow from the air inlet 33 of the drive cylinder 32 passes through the unrestricted flow branch 66. When shifted to the right, flow to the control valve 65 will be between ports 65D and 65C so as to direct flow between the control valve 65 and the air inlet 33 through the secondary speed metering assembly 67.

The port 60C of the directional control valve 60 is connected to the air inlet 34 through a secondary pressure regulator 69.

From the above detailed description of the pneumatic module 40 its operation is believed clear. However, the pneumatic schematics will aid in an understanding of its operation. Referring first to FIG. 6, which illustrates the sliding door 21 in its closed or at-rest position, the door 21 is biased in this position by the compressed air being supplied through the primary pressure regulator 43, through the control valve 60, and into the air inlet port 34 of the drive cylinder 32 as indicated by the cross-hatching in FIG. 6. The other end of the drive cylinder 32 is exhausted to the atmosphere through the air inlet 33, the unrestricted flow branch 66, the control valve 65, the control valve 60, through the closing speed metering assembly 62, control valve 50 closing cushion metering assembly 56, and exhaust 57.

Figure 7:
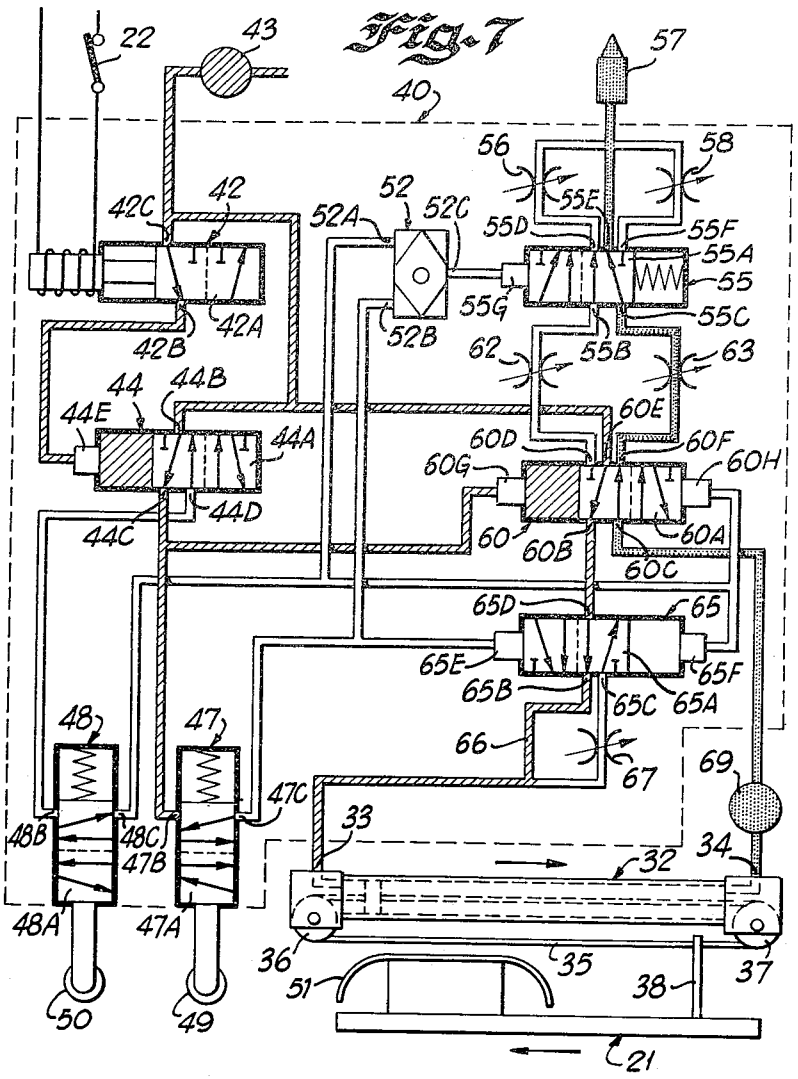
FIG. 7 is a schematic diagram of the door operator shown with the system in its initial door opening stroke.
Figure 5:
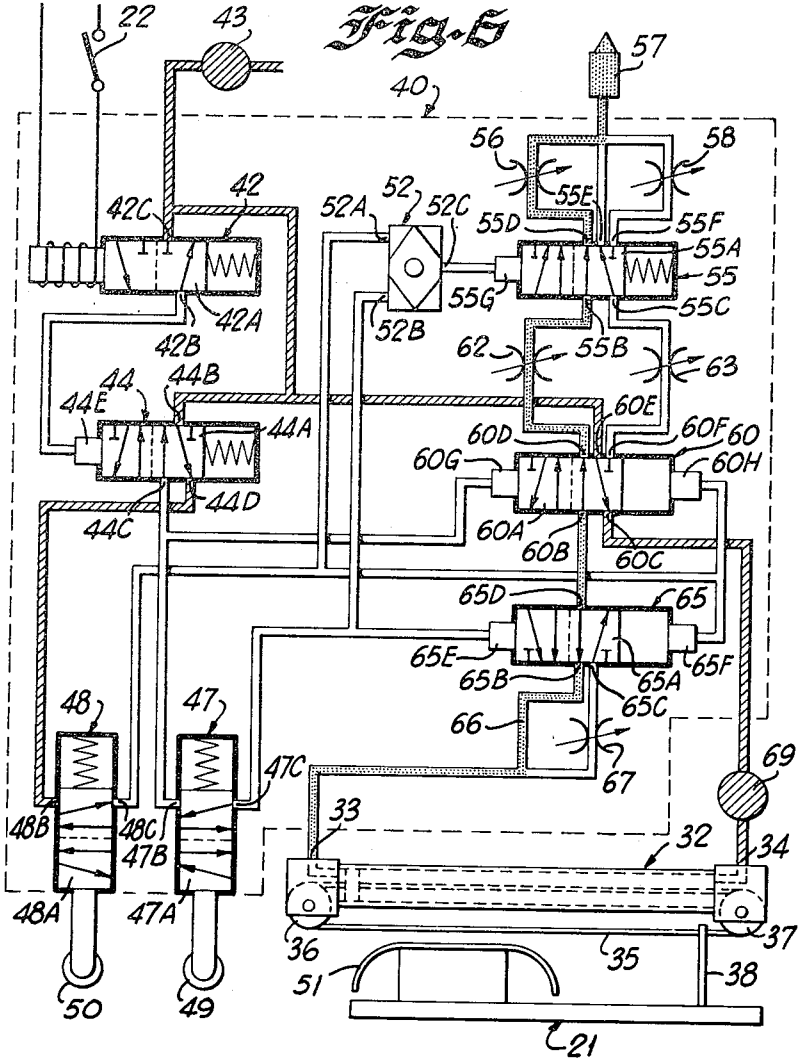

FIG. 7 illustrates the condition of the pneumatic circuit upon initial opening impulse to the door 21. In this position the electrical circuit 22 is closed, so as to shift the solenoid valve 42. This in turn shifts the spool of the interface valve 44 and of the control valve 60. Compressed air will now be directed unrestrictedly through the control valve 60, control valve 65, unrestricted flow branch 66, and into the air inlet 33 of the drive cylinder 32. At the same time the air inlet 34 of the drive cylinder 32 will be exhausted to atmosphere through the secondary pressure regulator 69, the control valve 60, the opening speed metering assembly 63, the control valve 55, and to exhaust. Since the supply of compressed air to the air inlet 33 is unrestricted, the door will begin to open with maximum speed and acceleration. The pressure in the exhaust side of the drive cylinder 32 will not yet have built up significantly and the opening speed metering assembly will not have significant restraint to the initial movement of the sliding door 21. Continued movement of the door 21 toward its open position, however, will depend both on the restraint provided by the opening speed metering assembly 63 and on the primary pressure. Both are adjustable to arrive at the desired result. Thus, the door starts to open instantaneously and continues at its maximum speed for approximately one-half of its full opening. At approximately one-half of the full opening of the door 21, the cam 51 comes in contact with the pneumatic switch 47.

Figure 9:
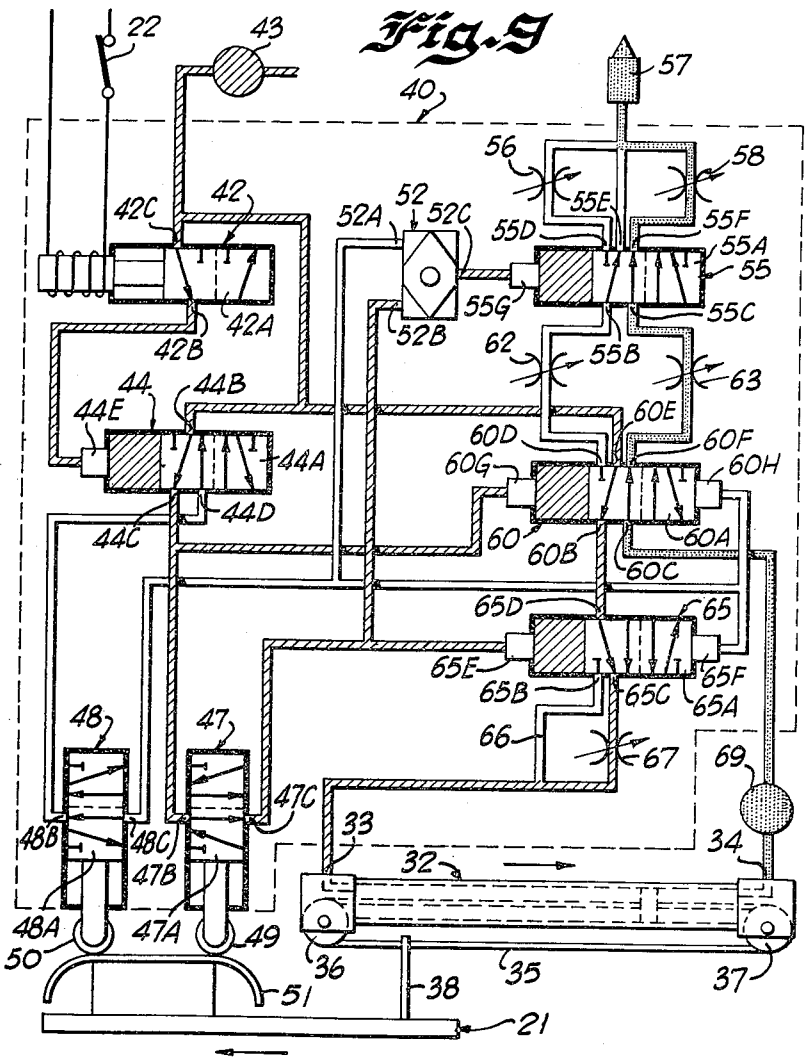
FIGS. 8 and 9 are schematic diagrams of the door operator shown with the door in intermediate positions of its opening stroke.
Figure 8:
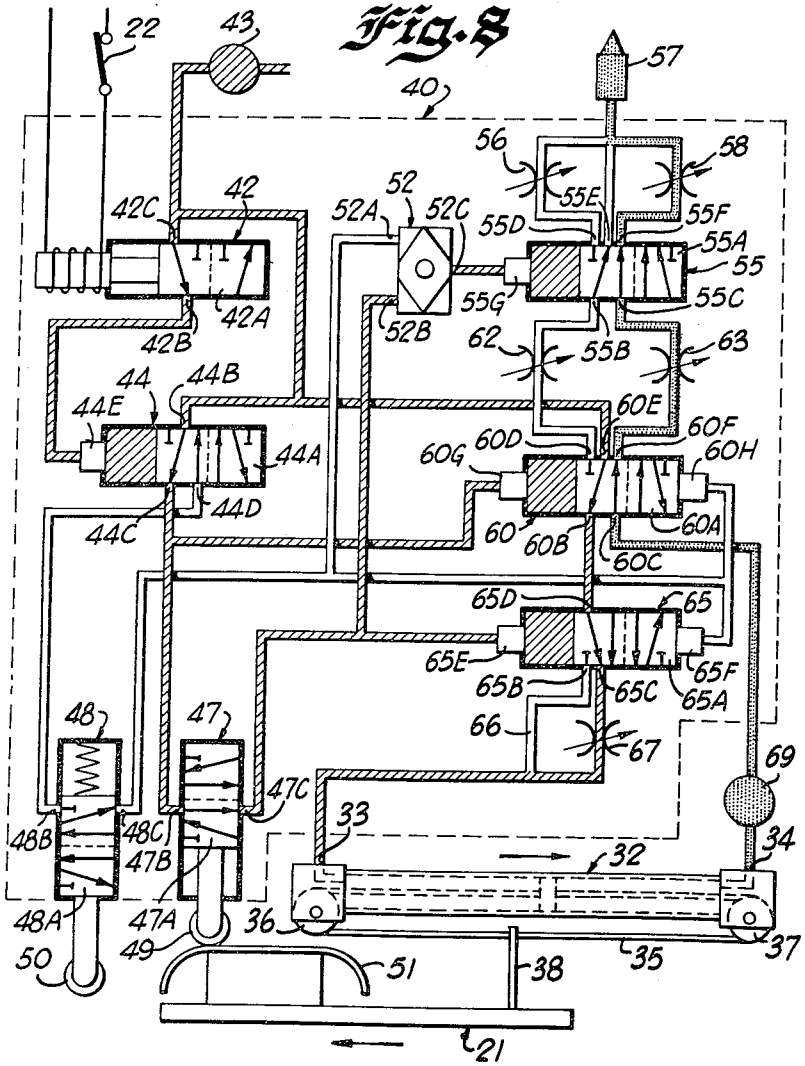

FIG. 8 illustrates the pneumatic flow after the pneumatic switch 47 has been shifted by the cam 51. Specifically, the spools in the control valves 55 and 65 are shifted. Shifting of the control valve 65 causes the primary pressure from the primary pressure regulator 43 to pass through the secondary speed metering assembly 67. This restricts the flow of fluid to the drive cylinder 32 thus causing the initial volume of air in the cylinder to expand; consequently, the pressure in the cylinder 32 drops. At the same time, the shift in the spool 55A of the valve 55 causes the pressure to pass through the restricted opening cushion metering assembly 58. Because of the restriction in the opening cushioning meter assembly 58, the exhaust air passes through the valve assembly very slowly; thus, the volume on this side of the drive cylinder 32 is compressed and the pressure is increased considerably as the door continues to open under its own momentum and inertia. The door, however, continues to decelerate as these conditions are maintained. The exhaust pressure at this time far exceeds the initial supply pressure for opening. As the door continues to move open, it contacts the pneumatic switch 48 but, as shown in FIG. 9, the shifting of pneumatic switch 48 does not alter the pneumatic flow at this stage.

Figure 11:
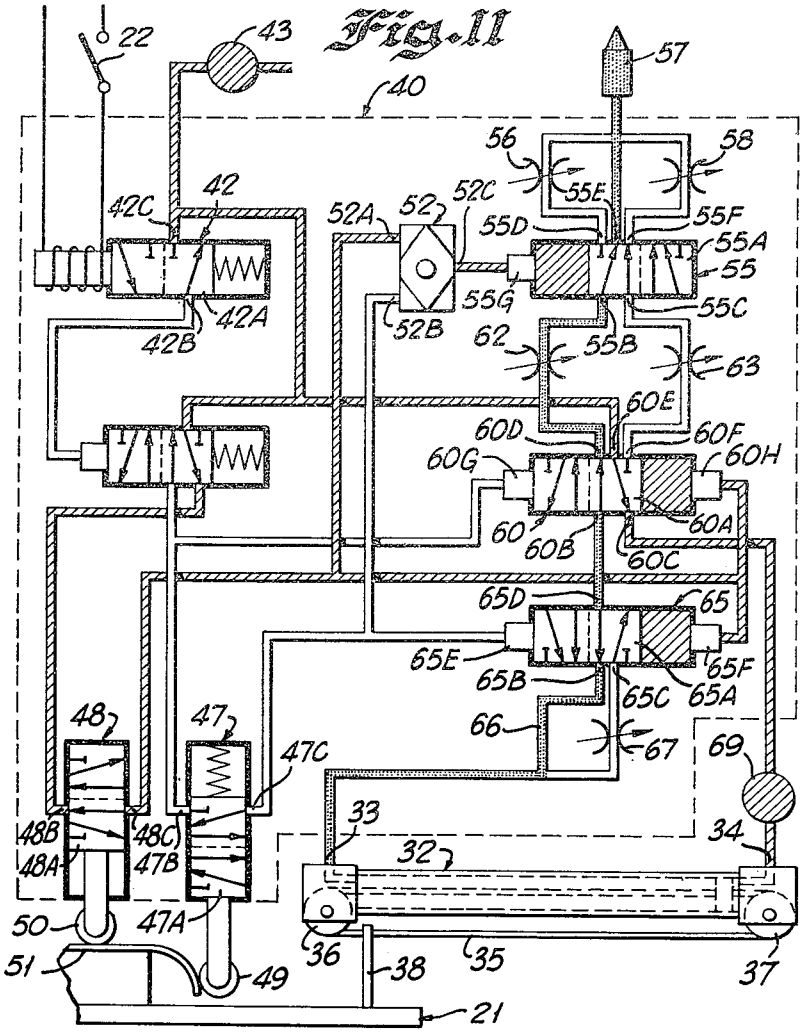
FIG. 11 is a schematic diagram of the door operator shown with the door in the initial step of its closing cycle.
Figure 10:
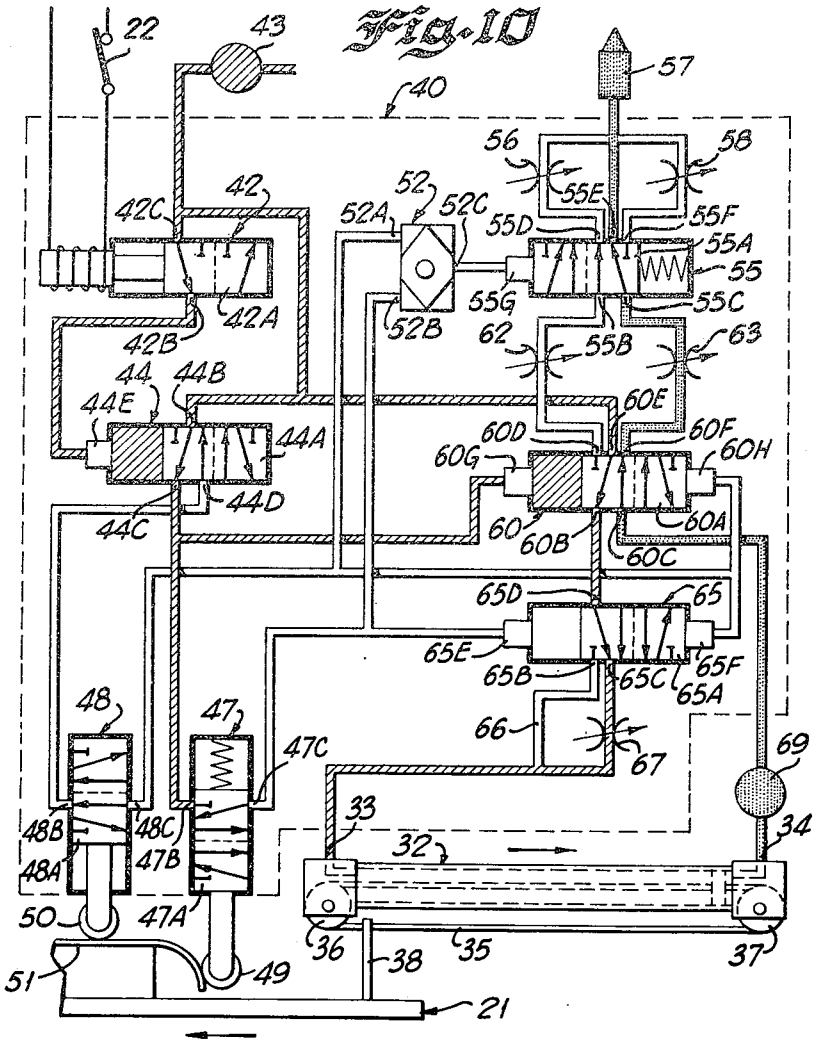
FIG. 10 is a schematic diagram of the door operator shown with the door in its fully opened position.
Figure 12:
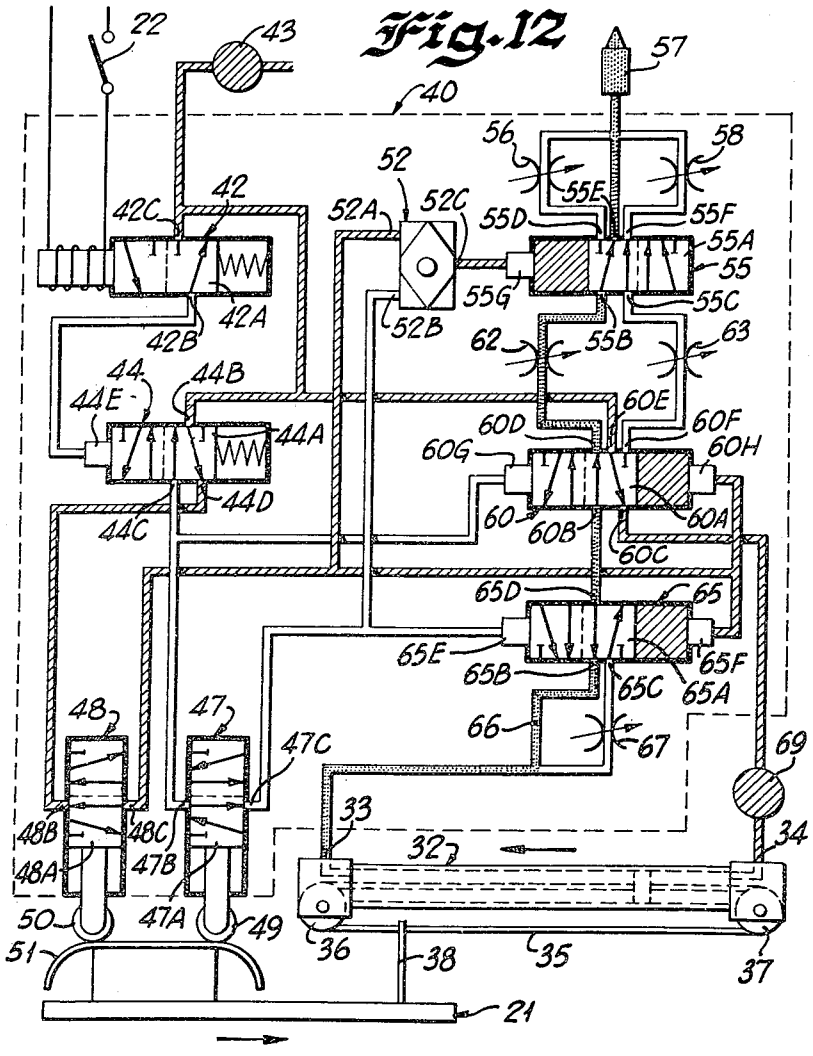

With the cam 51 in engagement with both the pneumatic switches 47, 48, the door continues to open under a constant deceleration. The exhaust pressure continues to rise until the door comes to a gentle stop. The cam 51 is designed and adjusted such that at this time it relieves the pneumatic switch 47 while it continues to contact the pneumatic switch 48. This change shifts the spool 55A in the directional control valve 55 as shown in FIG. 10 to exhaust the build up pressure. The opening pressure still passes through the secondary speed metering assembly 67. However, the door is maintained in a fully opened, at-rest position and no significant air flow takes place in the system. However, shortly, enough time will have elasped for a person to go through the entrance and release the switch of the treadle mat 22. This condition will cause a shift in the solenoid valve 42 back to its original position, also permitting a shift of the interface valve 44 back to its original or at-rest position. The shifting or return of the solenoid valve 42 will remove the compressed air from the pneumatic switch 47, and at the same time will direct the compressed air to the pneumatic switch 48. The shifting of these valves will in turn cause the spools 55A, 60A, 65A of the control valves 55, 60, 65 to shift. This series of events is illustrated in FIG. 11. The pressure passed through the secondary pressure regulator 69 to the air inlet 34 of the drive cylinder 32 and causes the door to start closing. The exhaust from the air inlet 33 of the drive cylinder 32 passes through the unrestricted flow branch 66, through the secondary speed control valve 65, into the directional control valve 60, and through the closing speed metering assembly 62, then through the speed control valve 55 and to exhaust. The closing speed can be adjusted to any desired level for any door by regulating the secondary pressure setting of the secondary pressure regulator 69 in conjunction with the setting of the restriction in the closing speed metering assembly 62. The door thus starts closing at a set speed. Although the cam 51 immediately comes in contact with the pneumatic switch 47, the flow conditions of the cycle are not changed, as illustrated in FIG. 12 and the door therefore continues to close at the same rate.

Figure 13:
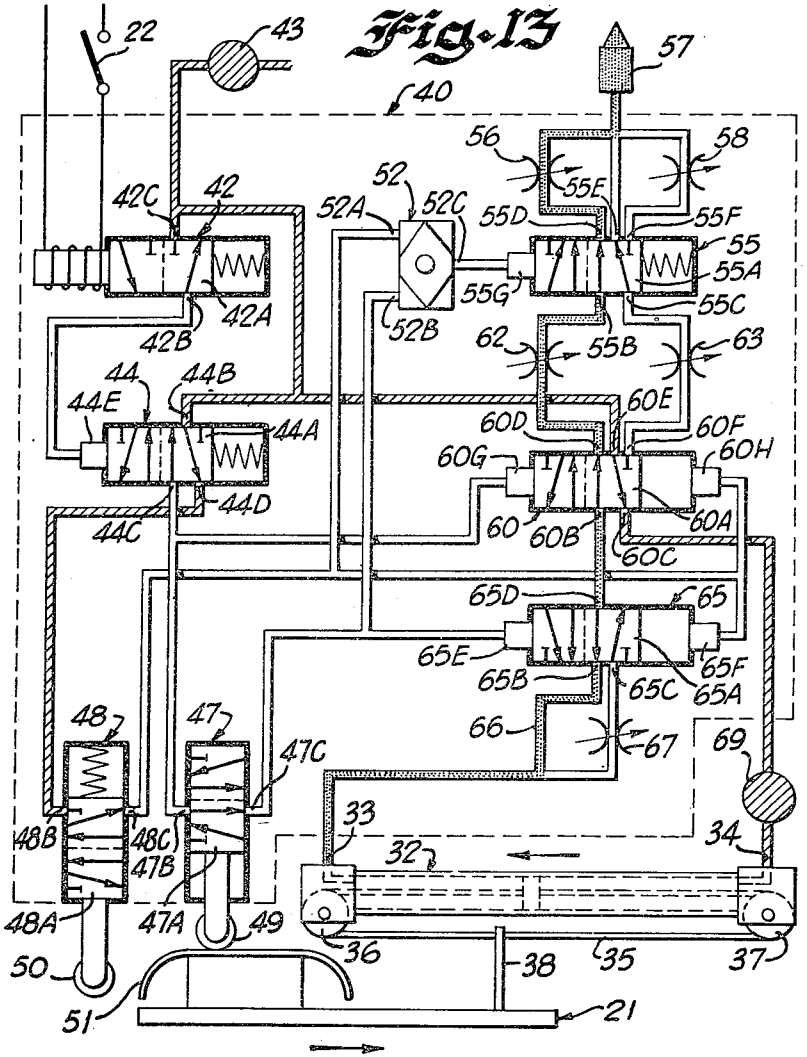
FIGS. 12 and 13 are schematic diagrams of the door operator shown with the door in intermediate positions of its closing stroke.

When the door is closed approximately one-half of its full travel, the cam 51 relieves the pneumatic switch 48 which causes the spool 55A of speed control valve 55 to shift, as shown in FIG. 13. The exhaust from the air inlet 33 of the drive cylinder 32 now must pass through the restricted closing cushion metering assembly 56. The closing cushion metering assembly is adjusted so that a very small amount of air escapes through this assembly, thus compressing the volume of air in the drive cylinder 32. As the door continues to close, the back pressure in the drive cylinder rises against a preset secondary closing pressure. The closing of the door causes the cam to relieve the pneumatic switch 47, but the pneumatic flow is not altered from that shown in FIG. 13. The door thus continues to close under a constant back pressure build up and finally the conditions are balanced so that the door comes to a gentle stop. Should someone activate the treadle mat 22 before the build up pressure escapes, then this pressure will immediately be dumped to atmosphere as shown in FIG. 7 previously described.

Figure 15:
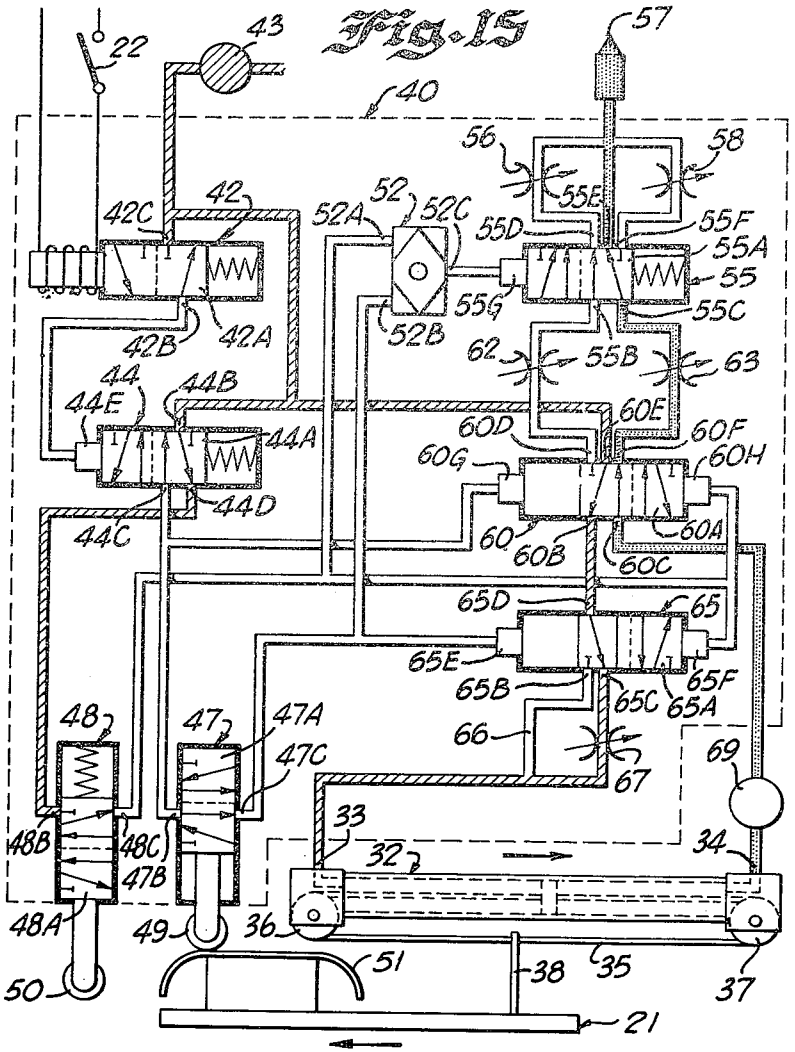
Figure 14:
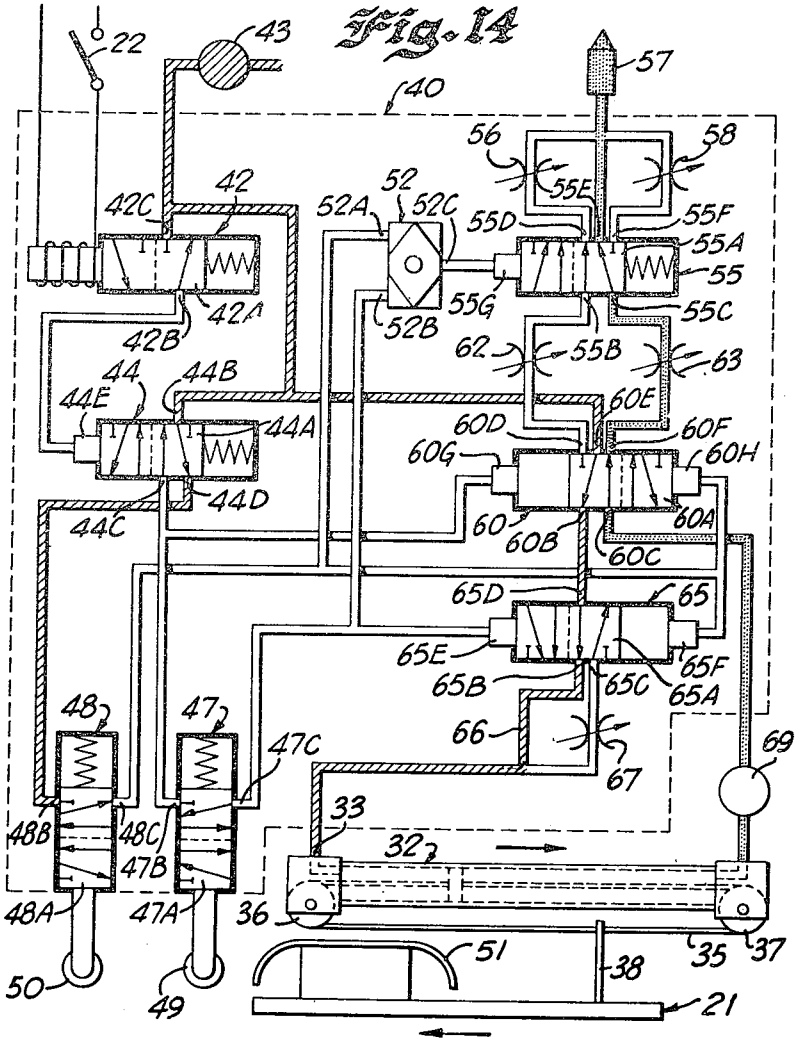

The above description covers the working of the automatic door operator under the standard cycle conditions of a single entry through the doorway. There are, however, instances of interrupting the operating cycle at many points of the door travel and the module logic circuit must reset itself and handle all such irregularities with equal control. FIGS. 14, 15 and 16 illustrate the condition wherein the treadle mat 22 is activated with the switch thereof closed, as shown in FIG. 7, but the person entering the doorway steps off the mat without passing through the doorway. Since the automatic door operator 25 received a signal to open, as shown in FIG. 7, it will continue to open even if the mat signal 22 is eliminated as shown in FIG. 14. It will continue to open with the fluid flow following the path shown in FIG. 15. However, upon the cam 51 shifting the pneumatic switch 48, the door will begin to close itself and will follow the paths and conditions shown in FIGS. 12 and 13, and come fully closed gently.

Figure 17:
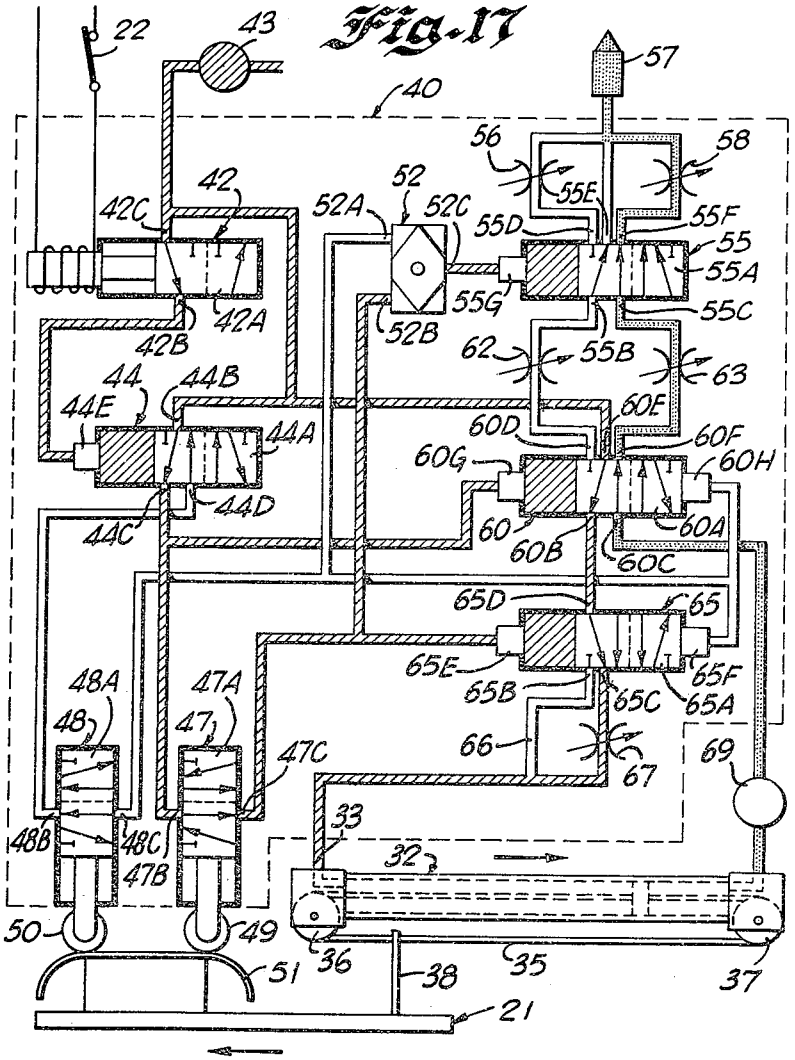
FIGS. 17 and 18 are schematic diagrams of the door operator shown in special mode condition wherein an open signal is received by the door during the door closing cycle.

As yet another frequently encountered abnormal mode, let us assume that the door 21 is in the closing cycle and has closed one-third of its stroke. The cam 51 is still in contact with both pneumatic switches 47 and 48. If the mat switch 22 is closed at this time by a party entering the doorway, the conditions in the pneumatic system will immediately change to the conditions illustrated in FIG. 17. The door will start reopening, but at a slower speed since the exhaust pressure passes through both the opening speed metering assembly 63 and the opening cushioning metering assembly 58, and will complete its normal cycle. If the mat switch should, at that time be released before the door has completed its opening, the automatic door operator 25 will immediately revert back to the closing mode with the conditions as shown in FIGS. 12 and 13.

Figure 18:
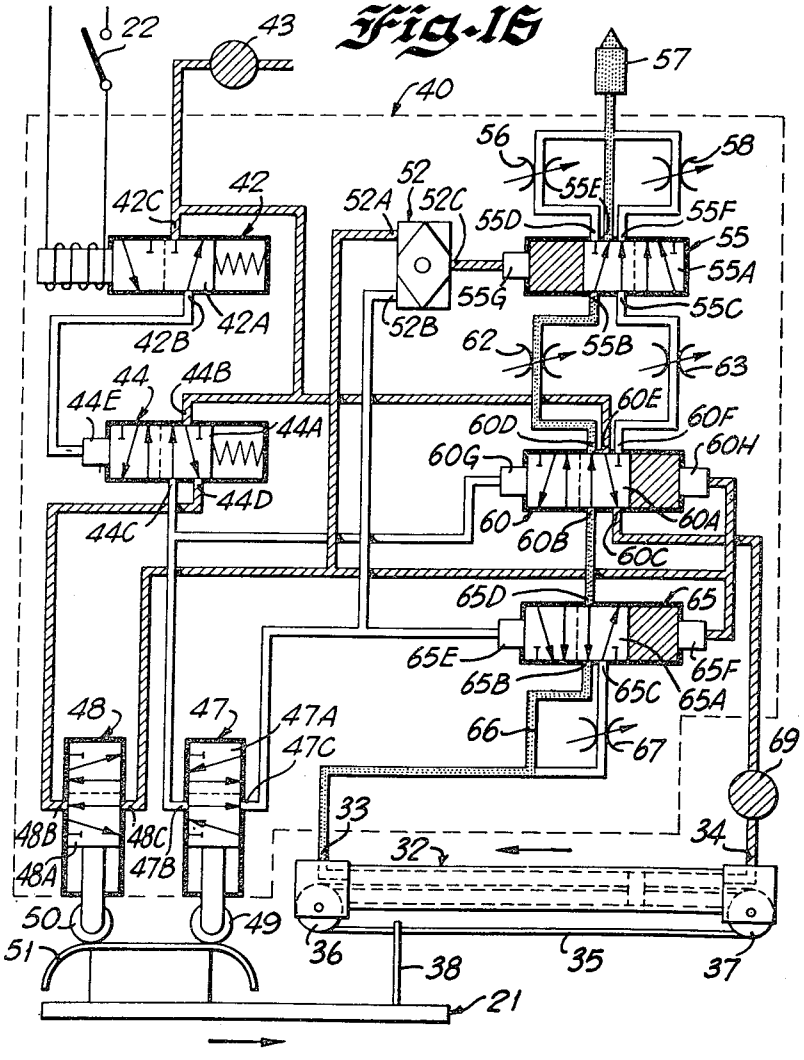
Figure 18:
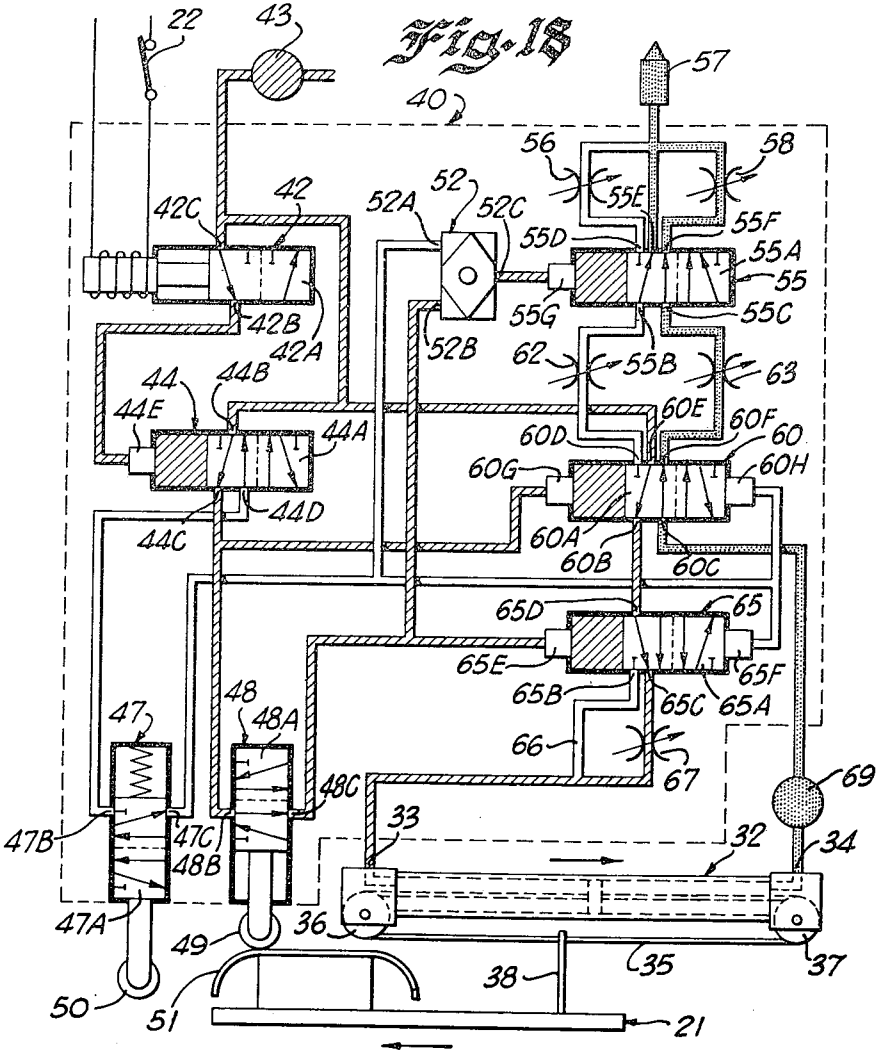
Figure 20:
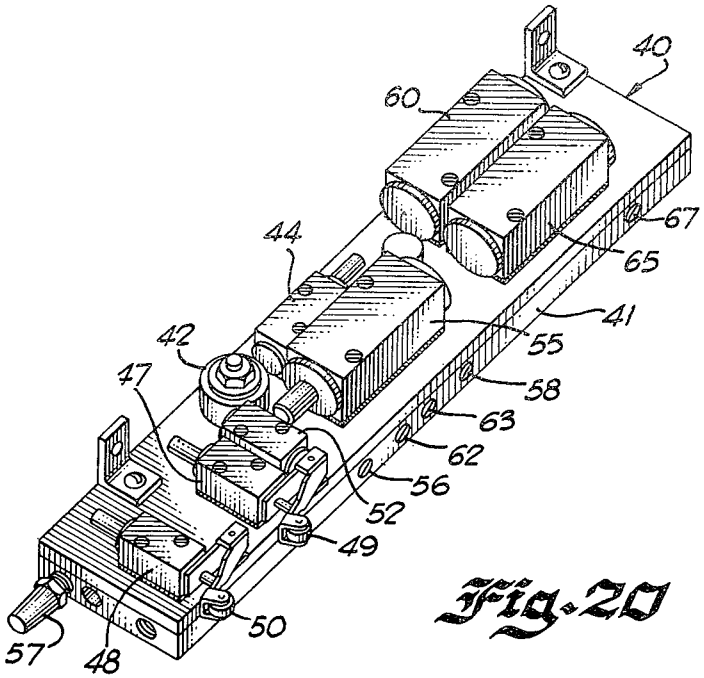
FIG. 20 is a perspective view of the automatic door operator.
Figure 19:
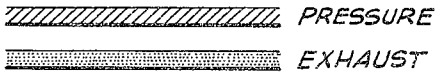
FIG. 19 is a legend for the schematics of FIGS. 6–18.

As yet another frequently encountered abnormal mode of operation, let us assume that the mat switch 22 is closed while the door is in its closing mode approximately one-half of its cycle such that the cam 51 is still riding on pneumatic switch 47, but has passed pneumatic switch 48. The door again will immediately start opening under the conditions shown in FIG. 18. The door again will open at a slower speed since the exhaust is passing through the opening speed metering assembly 63 and the opening cushioning metering assembly 58, and the intake pressure is supplied through the secondary speed metering assembly 67. If the mat signal 22 continues, the door will complete the opening cycle under the conditions as shown in FIGS. 8, 9 and 10. However, if the mat signal 22 is released before the door has completed its opening cycle, it will come closed along the modes illustrated in FIGS. 12 and 13.

Advantageously, there is provided a pneumatic automatic door operator 25 for opening and closing a sliding door 21 wherein there is maximum acceleration and deceleration of the door while bringing the door to a gentle stop at the end of each stroke without oscillation of the door or other undesirable operation. Moreover, the automatic door operator will automatically reset if interrupted during one of the operating strokes.

Although the present invention has been described by reference to only a single embodiment thereof, it will be apparent that numerous other modifications and embodiments will be devised by those skilled in the art which will fall within the true spirit and scope of the present invention.

What is claimed as new and desired to be secured by Letters Patent of the United States is:

1. An automatic door operator used in opening and closing a door which is mounted upon a door frame for sliding movement in a vertical plane between open and closed positions in response to movement of traffic adjacent the door, said door operator comprising:

a drive cylinder for mounting relative to said door frame having first and second fluid inlets;

a piston slideably movable within said drive cylinder through door opening and door closing strokes between said first and second fluid inlets;

a drive means for connecting said piston to a door to drive the door through the door opening and door closing strokes;

a means for supplying pressurized fluid from a suitable source thereof connected to said first and second fluid inlets and operable to supply pressurized fluid to either of said first and second fluid inlets;

control means interconnecting said supplying means with said first fluid inlet and connecting said second fluid inlet to exhaust continuously throughout an opening stroke and connecting said supplying means to said second fluid inlet and connecting said first fluid inlet to exhaust continuously throughout a closing stroke;

said control means including means for reducing the pressure of fluid acting on said piston from a side thereof in communication with one of said fluid inlets connected for supplying pressurized fluid to said cylinder after said piston has moved part way along on a stroke; and exhaust metering means metering the exhaust flow of fluid at least as the door approaches the end of its stroke.

2. An automatic door operator as defined in claim 1 which includes separate opening cycle metering controls metering the exhaust from said second fluid inlet during an opening stroke and closing cycle metering controls metering the exhaust from said first fluid inlet during a closing stroke.

3. An automatic door operator as defined in claim 2 wherein each of said metering controls includes separate cushioning controls rendered operative to cushion a door as it approaches the end of its stroke.

4. An automatic door operator as defined in claim 3 wherein said control means includes including inlet metering means operative during at least a portion of the opening stroke to meter the fluid flow to said operator.

5. An automatic door operator used in opening and closing a door which is mounted upon a door frame for sliding movement in a vertical plane between open and closed positions in response to movement of traffic adjacent the door, said door operator comprising:

a drive cylinder for mounting relative to said door frame having first and second fluid ports;

a piston slideably movable within said drive cylinder through door opening and door closing strokes between said first and second fluid ports;

a drive means for connecting said piston to a door to drive the door through the door opening and door closing strokes;

means for supplying pressurized fluid from a suitable source thereof connected to said first fluid port and operable to supply pressurized fluid thereto;

control means coupled to said supplying means connecting said source to said first fluid port and connecting said second fluid inlet to exhaust continuously throughout an opening stroke of the door;

said control means including means for reducing the pressure of fluid supplied through said first port on an opening stroke after a portion of said stroke has been completed; and exhaust metering means metering the exhaust flow of fluid at least as the door approaches the end of its stroke.

6. An automatic door operator used in opening and closing a door which is mounted upon a door frame for sliding movement in a vertical plane between open and closed positions in response to movement of traffic adjacent the door, said door operator comprising:

a drive cylinder for mounting relative to said door frame having first and second fluid inlets;

a piston slideably movable within said drive cylinder through door opening and door closing strokes between said first and second fluid inlets;

a drive means for connecting said piston to a door movable through door opening and door closing strokes;

means for supplying pressurized fluid from a suitable source thereof for moving said piston in said cylinder;

first and second pneumatic switches;

cam means carried on said door adapted to shift said switches in response to the position of the door relative to said frame;

a directional control valve means for alternating connecting said first and second fluid inlets selectively to said means supplying pressurized fluid and to exhaust respectively;

a speed control valve connected between said directional control valve and exhaust for metering the exhaust flow at different rates;

a shuttle valve controlling the mode of operation of said speed control valve between said different rates;

a secondary speed control valve connected between said directional control valve means and said first fluid inlet selectively metering the inlet flow from said supply means;

a solenoid valve;

a transfer valve connected to said solenoid valve and said means supplying pressurized fluid and further connected to said pneumatic switches; and conduit means interconnecting said pneumatic switch with said shuttle valve, and secondary speed control valve.

7. The automatic door operator of claim 1 wherein said pressure reducing means comprises means for reducing the pressure of fluid acting on said piston during a door opening stroke after said piston has traversed a portion of said door opening stroke in said cylinder.

8. The automatic door operator of claim 7 wherein said pressure reducing means includes a fluid valve actuated by movement of said door on an opening stroke.

* * * * *